US010113735B2

(12) United States Patent
Emerson et al.

(10) Patent No.: US 10,113,735 B2
(45) Date of Patent: Oct. 30, 2018

(54) MODULAR LED LIGHTING DEVICE WITH DIFFERENT INTERCHANGEABLE LED HEADS

(71) Applicant: Light & Motion Industries, Marina, CA (US)

(72) Inventors: Daniel T. Emerson, Carmel, CA (US); Jarod Armer, Royal Oaks, CA (US); Eric Simon, Del Rey Oaks, CA (US); Brooks Patrick Lame, Seaside, CA (US)

(73) Assignee: Light & Motion Industries, Marina, CA (US)

( * ) Notice: Subject to any disclaimer, the term of this patent is extended or adjusted under 35 U.S.C. 154(b) by 65 days.

(21) Appl. No.: 15/427,842

(22) Filed: Feb. 8, 2017

(65) Prior Publication Data

US 2018/0224111 A1 Aug. 9, 2018

(51) Int. Cl.

| | |
|---|---|
| ***F21V 29/58*** | (2015.01) |
| ***F21V 31/00*** | (2006.01) |
| ***F21S 2/00*** | (2016.01) |
| ***F21S 9/02*** | (2006.01) |
| ***F21K 9/62*** | (2016.01) |
| ***F21V 29/67*** | (2015.01) |
| ***F21V 29/81*** | (2015.01) |
| ***F21V 21/28*** | (2006.01) |
| ***F21V 29/74*** | (2015.01) |
| ***F21V 23/06*** | (2006.01) |

(Continued)

(52) U.S. Cl.

CPC ..... *F21V 29/58* (2015.01); *F21K 9/62* (2016.08); *F21S 2/005* (2013.01); *F21S 9/02* (2013.01); *F21V 21/28* (2013.01); *F21V 23/06* (2013.01); *F21V 29/67* (2015.01); *F21V 29/74* (2015.01); *F21V 29/81* (2015.01); *F21V 31/005* (2013.01); *F21W 2131/406* (2013.01); *F21Y 2115/10* (2016.08)

(58) Field of Classification Search

CPC ..... F21V 29/58; F21S 2/005; F21Y 2115/10
See application file for complete search history.

(56) References Cited

U.S. PATENT DOCUMENTS

| | | | | |
|---|---|---|---|---|
| 7,618,154 | B2 * | 11/2009 | Rosiello | F21L 4/00 362/202 |
| 8,070,308 | B1 | 12/2011 | Lo et al. | |
| 8,545,069 | B2 | 10/2013 | McCaslin et al. | |

(Continued)

OTHER PUBLICATIONS

Sekonic, description and views of Sekonic light meter L-478DR-U, print from Sekonic.com website, copyright 2016, one page.

*Primary Examiner* — Robert May
(74) *Attorney, Agent, or Firm* — Thomas M. Freiburger

(57) ABSTRACT

A portable LED light has a series of different LED heads, with different light characteristics, for connection to a lighting device body that includes a battery and LED driver electronics. Each of the different light heads can have specific light color temperatures, maximum intensities and other features. A heat sink with cooling fins dissipates heat from the LEDs, and a fan can be included, either on the housing or on a light head. An alternative light head can be for underwater use, with the internal LEDs and electronics of the light head, as well as the body, being water sealed. Cooling of the underwater form of light is by direct contact of a heat sink with surrounding water.

30 Claims, 12 Drawing Sheets

(51) Int. Cl.
*F21Y 115/10* (2016.01)
*F21W 131/406* (2006.01)

(56) References Cited

U.S. PATENT DOCUMENTS

| | | | | |
|---|---|---|---|---|
| 8,733,989 | B1 | 5/2014 | Lo et al. | |
| 8,770,808 | B1 | 7/2014 | Campbell et al. | |
| 8,864,326 | B2 | 10/2014 | Armer et al. | |
| 9,188,292 | B2 | 11/2015 | Armer et al. | |
| 9,239,512 | B2 | 1/2016 | Foss et al. | |
| 9,746,170 | B1 * | 8/2017 | Armer | F21V 29/58 |
| 2011/0122609 | A1 | 5/2011 | Dahlin | |
| 2015/0247632 | A1 | 9/2015 | McGilvray | |
| 2016/0215967 | A1 | 7/2016 | Chad | |

* cited by examiner

FIG. 13
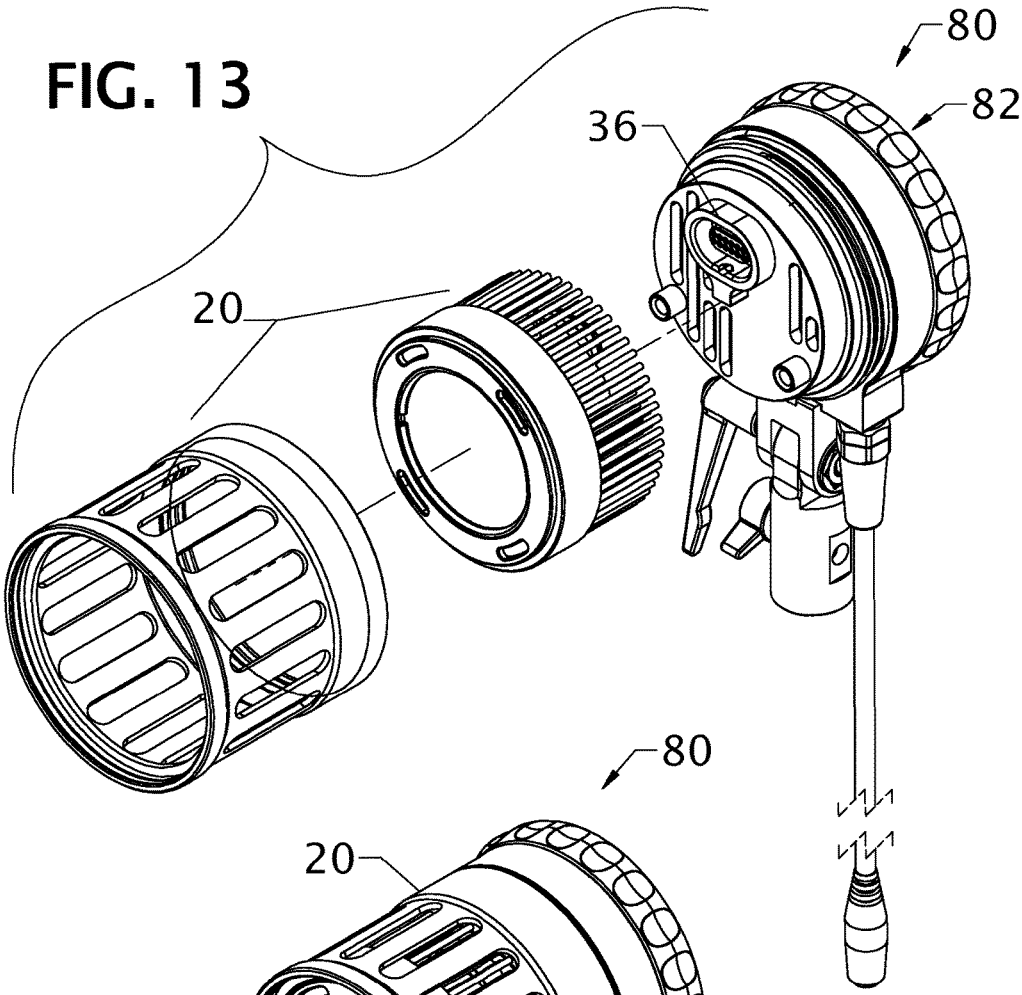
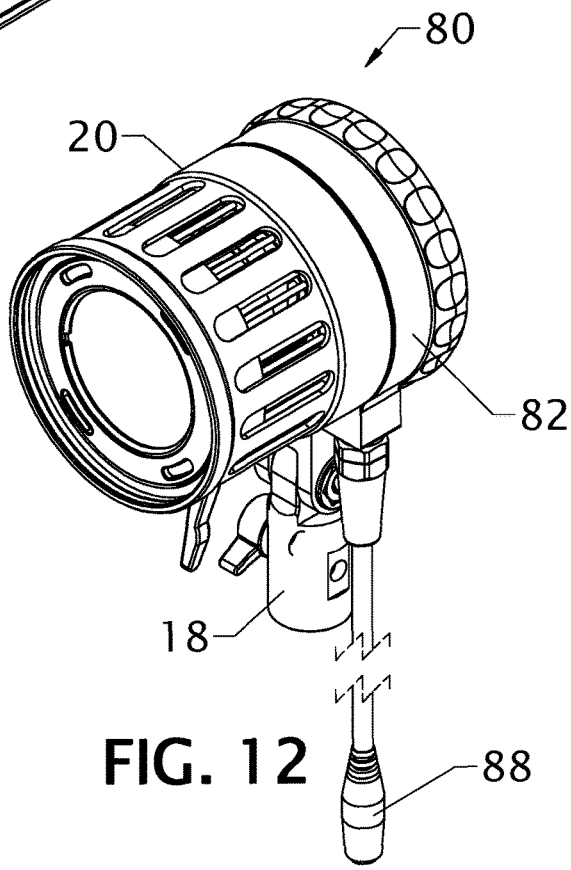
FIG. 12

MODULAR LED LIGHTING DEVICE WITH DIFFERENT INTERCHANGEABLE LED HEADS

BACKGROUND OF THE INVENTION

This invention is in the field of lighting devices, particularly LED lighting, and in particular relates to high intensity LED lighting for film or stage production and other uses, which may include underwater applications. The invention is a versatile light assembly with interchangeable LED heads.

The owner of this invention has several patents on LED lighting devices, particularly for underwater use. See, for example, U.S. Pat. Nos. 9,239,512, 9,188,292 and 8,864,326. In addition, see U.S. Pat. Nos. 8,770,808, 8,733,989, 8,545,069 and 8,070,308, owned by the same assignee and relating to above-ground LED lighting devices.

High-powered LED lights, wherein the LEDs are clustered together, and particularly those that output 4000 lumens, 8000 lumens or even more, face serious cooling issues. In U.S. Pat. No. 8,864,326 an underwater diving light is described having openings for entry of water into the light assembly to contact an LED driver PC board, so that ambient water circulates through the lighting device and cools the LEDs. Above ground, the situation is more critical, since only air is readily available for cooling the LEDs. The LEDs will not perform well and will ultimately degrade if allowed to overheat.

The invention makes changing light color temperature, which is often critical in film and video work, very easy and efficient. In contrast, previous stage lighting has included heads with multicolor LEDs, wherein in 3200K and 5600K light outputs are mixed to create different color temperature output between those two end points. A major problem with this scheme is that at any time, regardless of the color temperature selected, only one half of the LED array may actually be energized, tending toward larger and heavier lights with complex and costly controls. In addition, variable color heads, called in the trade "bi-color", are notoriously unstable, meaning the active mixing is not highly repeatable and wanders off the setting due the complexity of controlling a large array of LEDs. A fixed head with factory set color temperature is highly stable and maintains its color setting far better than variable controlled LED arrays.

SUMMARY OF THE INVENTION

The current invention is embodied in a compact, portable LED lighting device, having a body that contains a battery and associated circuitry, and a series of different LED heads, any of which can be attached to the body, preferably via a threaded front bezel that secures the LED head against the body into which it is plugged. The various LED heads provide different levels of light and different characteristics of light, particularly different lighting color temperatures (although other parameters such as projection angle can be selectable), and these lights in various forms are useful in stage productions, television and other film and video recorded events. Preferably, but not necessarily, the set of LED assemblies can include one or more underwater LED assembly, wherein the LED head includes provision for admitting water into the assembled lighting device for LED cooling.

Some of the air-cooled front LED assemblies include a fan for moving air over a heat sink comprising cooling fins; the fan can be built into the LED/heat sink unit or into the light body. Also included are front LED assemblies with cooling fins cooled by natural air convection, without a fan. For underwater applications a front LED unit can have a small heat sink contacted directly by ambient water.

It is a primary object of the invention to provide a system of portable, compact LED lighting with versatility to serve different lighting needs and situations, with high-output LED light, wherein the applications can include underwater use. These and other objects, advantages and features of the invention will be apparent from the following description of a preferred embodiment, considered along with the accompanying drawings.

DESCRIPTION OF THE DRAWINGS

FIGS. 12-14 are views showing another form of the modular LED lighting device, wherein a remote power supply is utilized.

DESCRIPTION OF PREFERRED EMBODIMENTS

Figure 1:
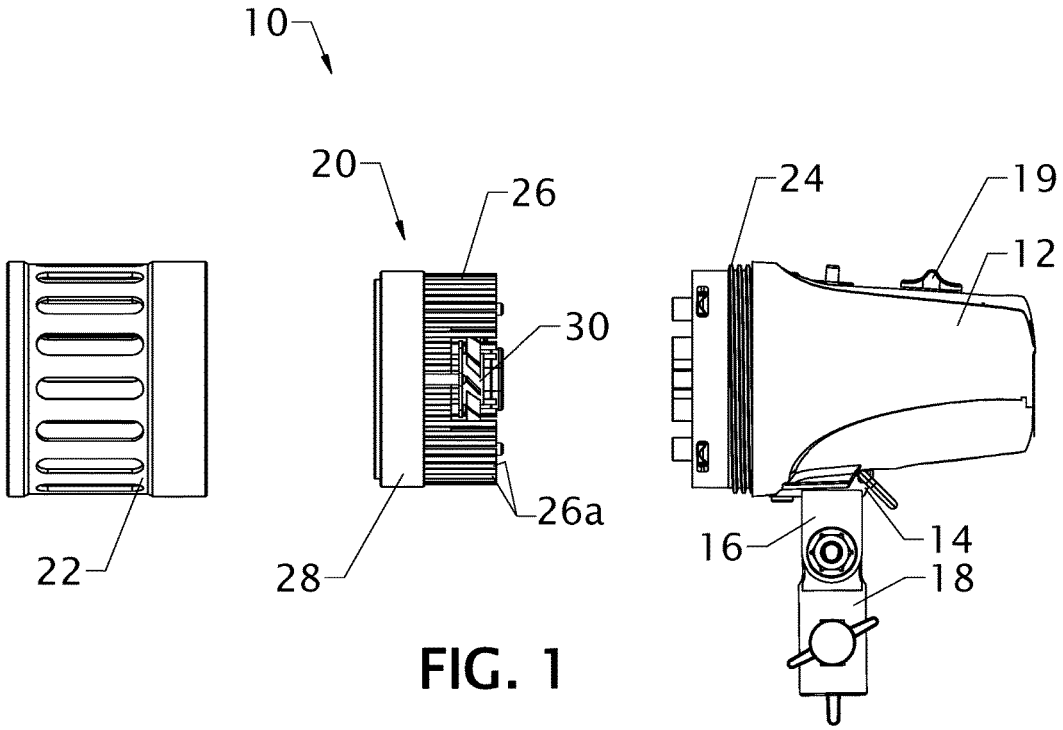
FIG. 1 is an exploded view in side elevation showing a modular LED lighting device of the invention, with an air cooled LED head and a battery-containing body to which the LED head can be secured.

FIG. 1 shows in exploded view an embodiment of an LED lighting apparatus 10 of the invention. The device includes a housing or body 12 that contains a battery and electronics. The body 12 can be the same as or similar to the underwater light body shown in U.S. Pat. Nos. 9,188,292 and 8,864,326. The housing or body 12 includes a mount 14 for securing any of various brackets or mounting devices for securing to a camera, a floor stand or other apparatus depending on the situation to which the lighting device 10 is applied. FIG. 1 shows a bracket 16 with a swivel fitting 18, illustrating a "C" stand receiver commonly used to position a light on a tripod style stand and allowing the light to rotate and pivot back and lock in position. Other brackets or receiver types could also be used, as standards differ for light stands in different locations. FIG. 1 also shows a switch 19, which can be a waterproof slide switch with magnetic coupling to internal-switch contacts as in U.S. Pat. No. 9,188,292. Multiple-button switches could be used as an alternative, still waterproof and preferably magnetically coupled, as further explained below.

In the exploded view of FIG. 1 an LED head 20 is shown as being secured to the body 12, which is by a front bezel 22 that engages over the LED head once the head has been brought into connective contact with the front of the body, by screwing the bezel 22 onto the body via threads 24 and mating threads formed internally in the bezel 22, not shown. Other types of connection could also be used. In this case the LED head has a heat sink 26 comprising a large number of metal pins, e.g. over 100 such pins 26*a*, extending back from a metal front ring 28, this heat sink assembly better seen in FIG. 2.

Figure 2:
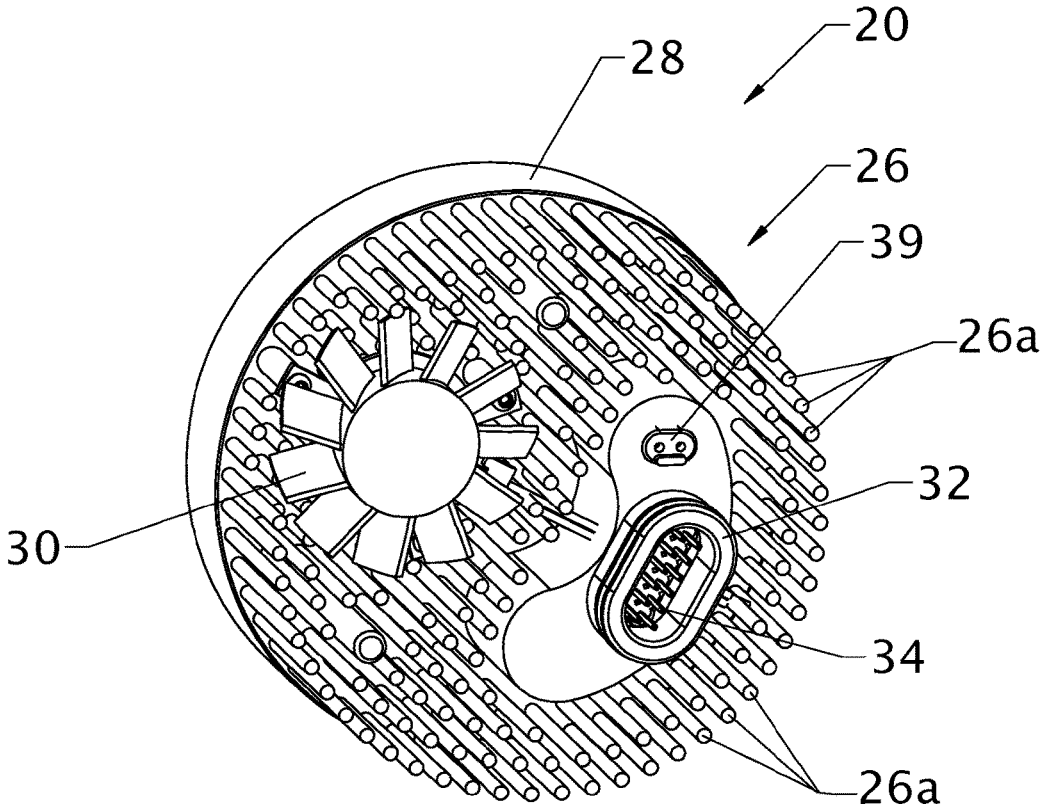
FIG. 2 is a perspective view showing the LED head.
Figure 4:
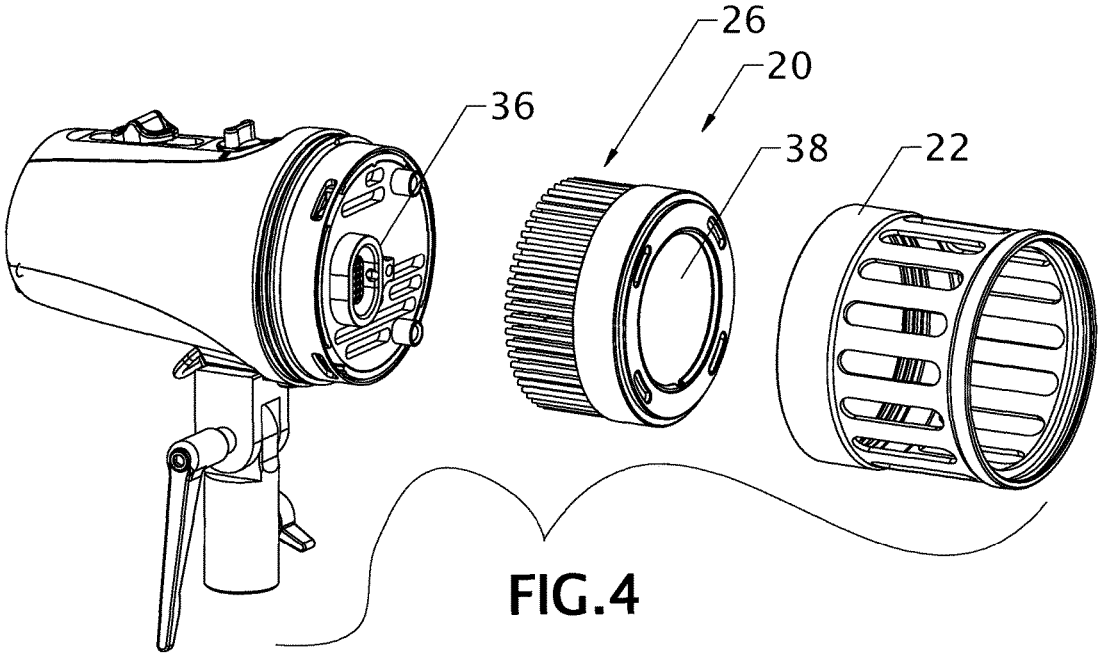
FIG. 4 is a perspective view, exploded, showing an assembly similar to that of FIG. 1.

A small fan 30 is incorporated in the LED head 20 in this embodiment as seen in FIG. 2. The fan rotates on an axis parallel to and offset from an axial center line of the light body 12 and of the head 20 and bezel 22. The fan may be about 40 mm (1.6 inches) in diameter, for example, on an LED head 20 having a diameter of about 90 mm (3.5 inches). The fan 30 requires only a small motor, such as a Model F-4008H12BJV, manufactured by Cofan USA of Fremont, Calif. The low-voltage motor can be fed power via a connecting hub 32 of the LED/sink head 20. As shown, within the hub are a series of electrical connector pins 34, for coupling with sockets in a receiving hub 36 on the front body 12, as shown in FIG. 4. The hub connection supplies power for LEDs in an array (not shown) within the LED head, behind a sealed window 38 of the head. The hub itself engages in water-sealed relationship with the receiving hub 36, and with an O-ring seal. Alternatively, the fan could be powered via a wire from the body (not shown) that is plugged into a small grommet 39 shown to the right of the pin connector hub 32. The fan is designed to allow the user to easily change it in the event that the fan is shorted or otherwise fails. The entire head and body assembly is fully waterproof but the fan is not and can be shorted out if it becomes wet; the easy to change fan is a feature for this product.

Preferably the compact assembly 10 is no wider than about 3.5 inches in diameter, or a range of 3 inches to 3.8 inches, at the bezel 22.

Figure 2A:
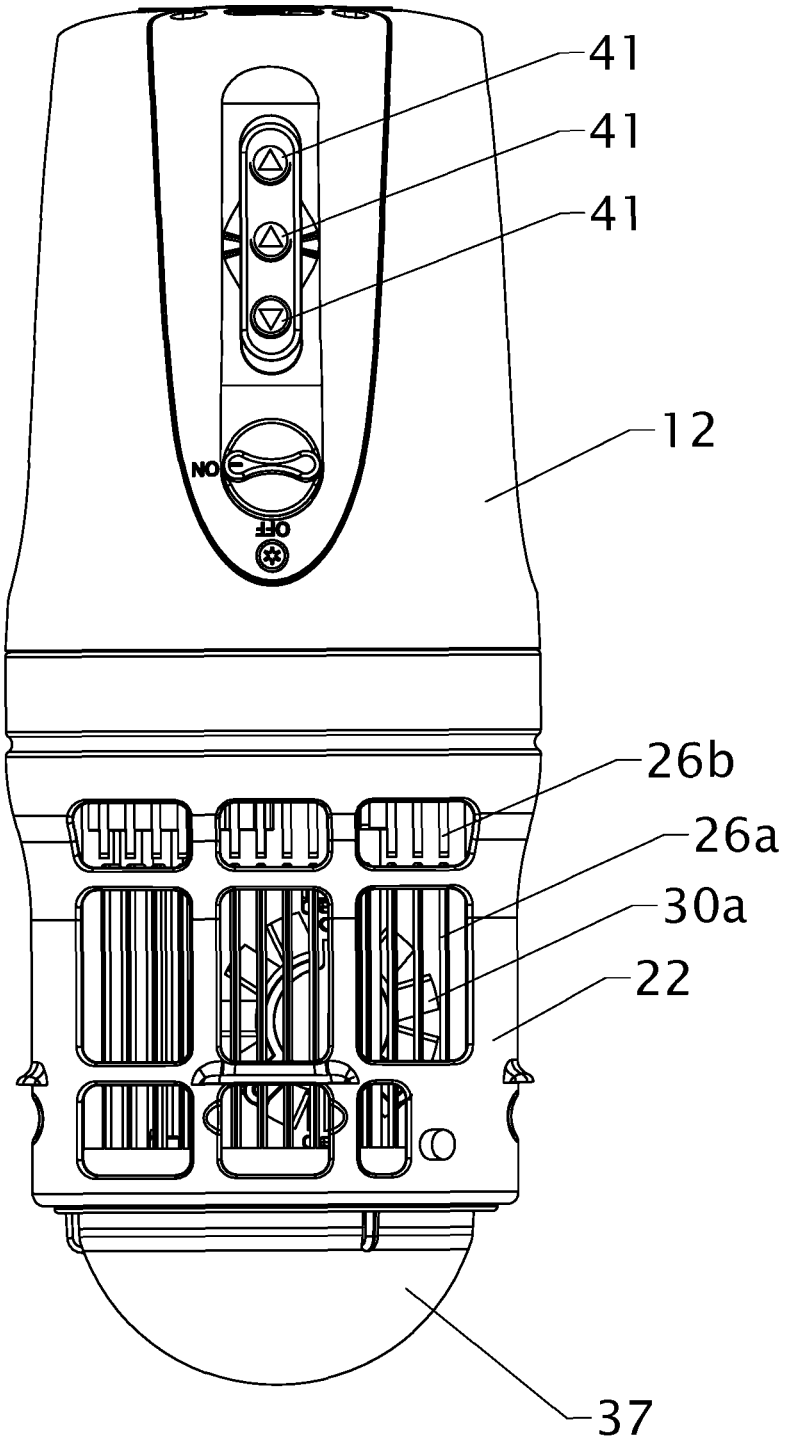
FIG. 2A is a top view showing an alternative form of light head on the body.

FIG. 2A shows alternatives to the some of the features shown in FIGS. 1 and 2. In FIG. 2A the fan 30*a* is on an axis perpendicular to the through-axis of the head and the entire assembly, so that air is moved across all the heat sink pins for more efficient cooling flow. The fan creates air flow perpendicular to the LED array that is mounted at the front of the head, just behind a light diffuser dome 37 shown in this view. In FIG. 2A the heat sink pins 26*a* are shown separated from heat sink pins 26*b* on the body 12, included to cool the LED driver and battery that are contained in the body. When the bezel 22 is removed, the LED module unplugs in the same manner as described previously.

FIG. 2A also shows multiple push-button switches 41 that can be employed for lighting control, in lieu of the slide switch of FIG. 1, as described above.

Figure 2B:
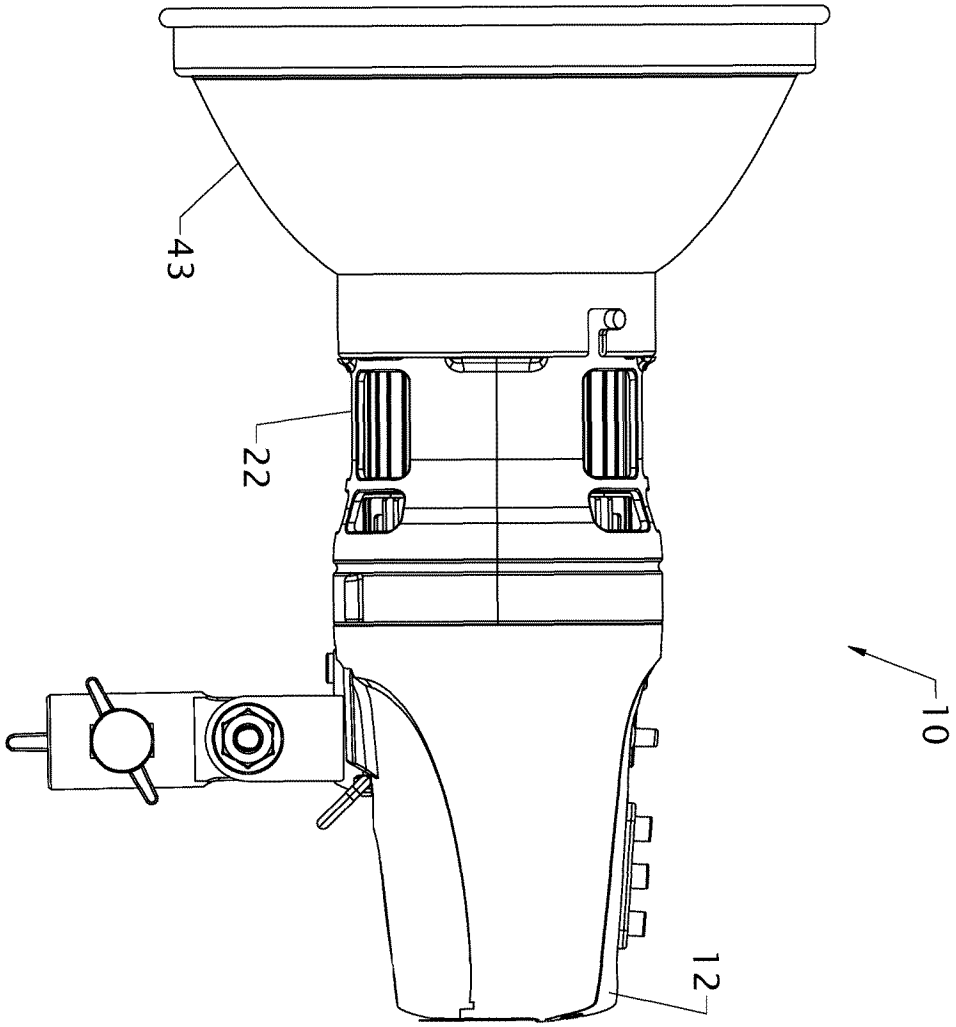
FIG. 2B is a side view showing the assembled unit with a light shaping tool attached onto the bezel at front of the unit.

FIG. 2B illustrates that the bezel 22 can be configured to receive a light shaping tool as desired, such as shown at 43.

Figure 5:
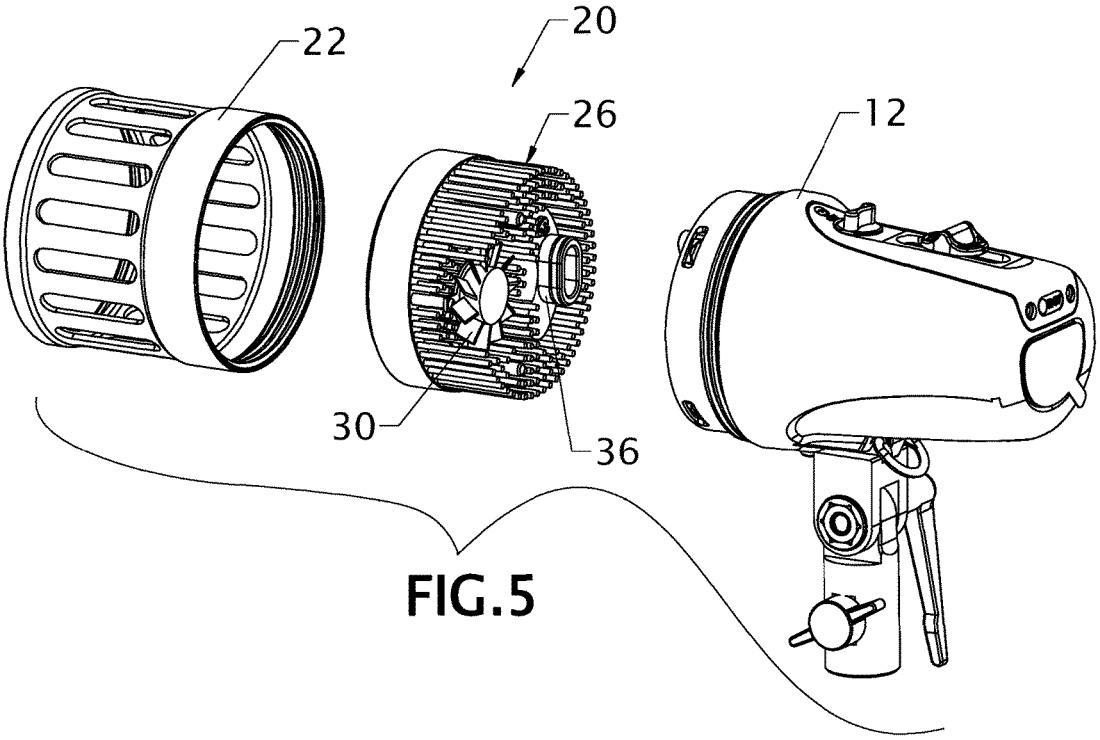
FIG. 5 is another exploded perspective view of the FIG. 4 assembly.

FIG. 5 shows the components in exploded view from a different angle, revealing the fan 30 (with rotation axis in the axial orientation).

Figure 3:
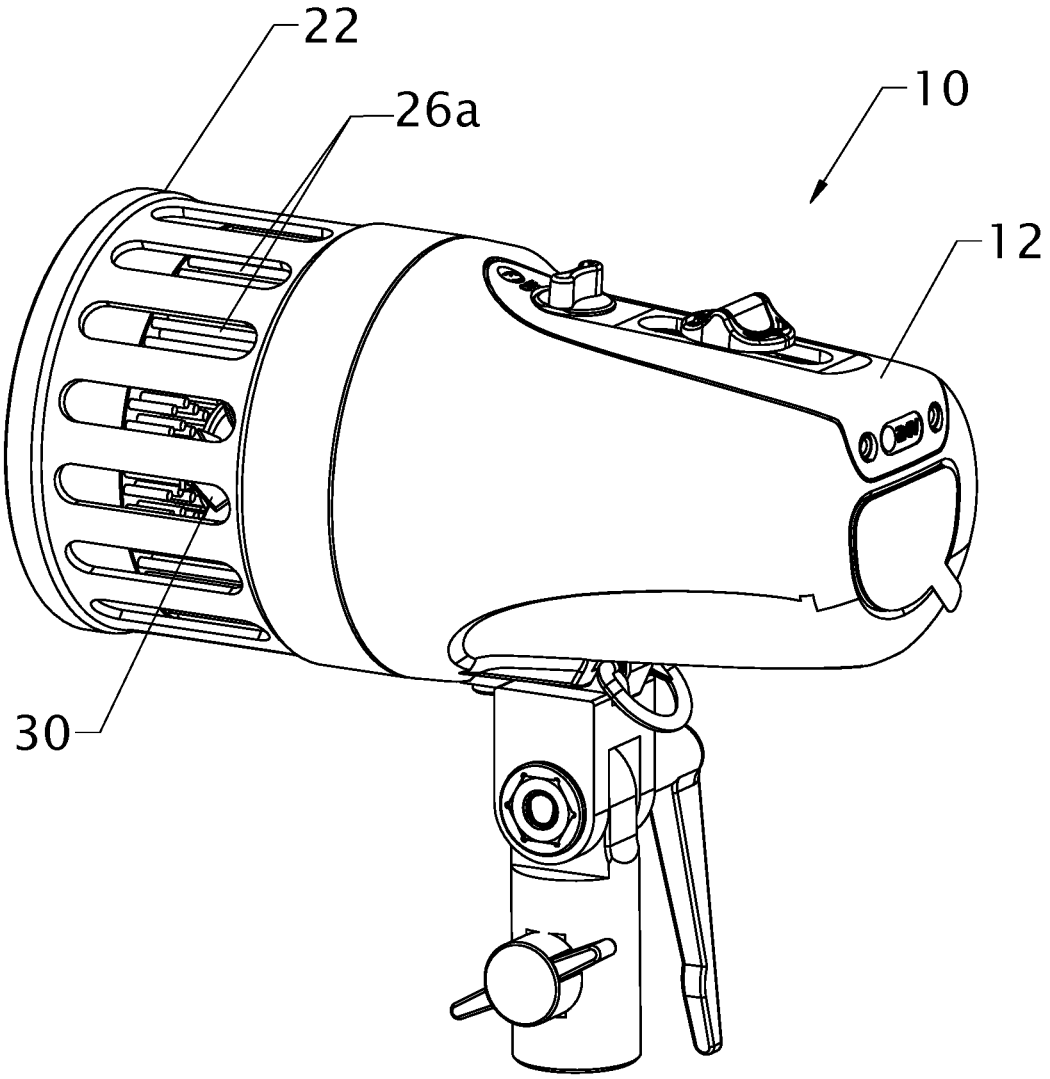
FIG. 3 is a perspective view showing the device of FIG. 1 assembled.

The small fan 30, also partially seen in the assembled view of FIG. 3, is efficient to move air through and among the heat sink pins 26*a* so as to carry away enough heat from the LEDs that the head can deliver up to at least 10,000 lumens light output from a small lighting device only about 90 mm in diameter, for example. The perspective view of FIG. 8 also shows the fully assembled unit, and with an additional accessory 40 attached to the front of the bezel, providing adjustable reflectors for better light control in filming situations.

Figure 8:
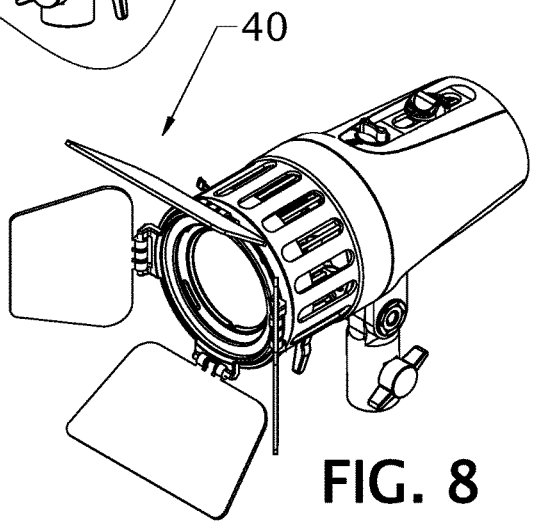
FIG. 8 is a perspective view showing the assembled lights with a reflector device, one of many light modifiers that are press fit or secured against the face of the light to control or modify the light for cinema operations.
Figure 9:
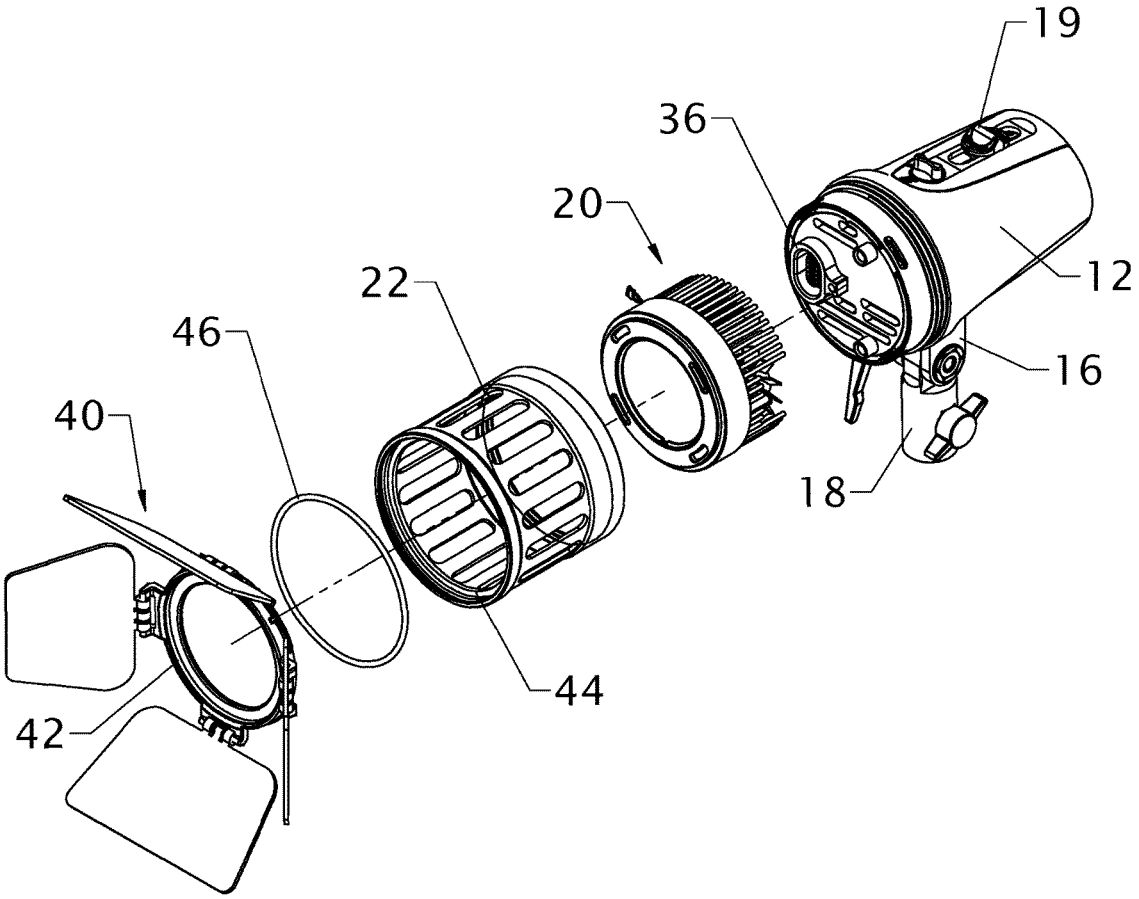
FIG. 9 is an exploded view of the FIG. 8 assembly.

FIG. 9 shows the assembly of FIG. 8, but exploded. The reflector accessory 40 may have an annular base 42 that is threadedly secured into the front 44 of the bezel 22. Also shown is an O-ring 46 that provides friction for mounting of a wide range of light modifiers including the barn doors shown in the drawing. Other modifiers include a 50 degree spot, a 25 degree spot, and a dome (as in FIG. 2A) with a diffuser to spread the light. The current embodiment uses a press-on attachment with the O-ring creating compression to hold the modifiers in place. A threaded interface such as a bayonet mount could alternatively be used already.

Figure 6:
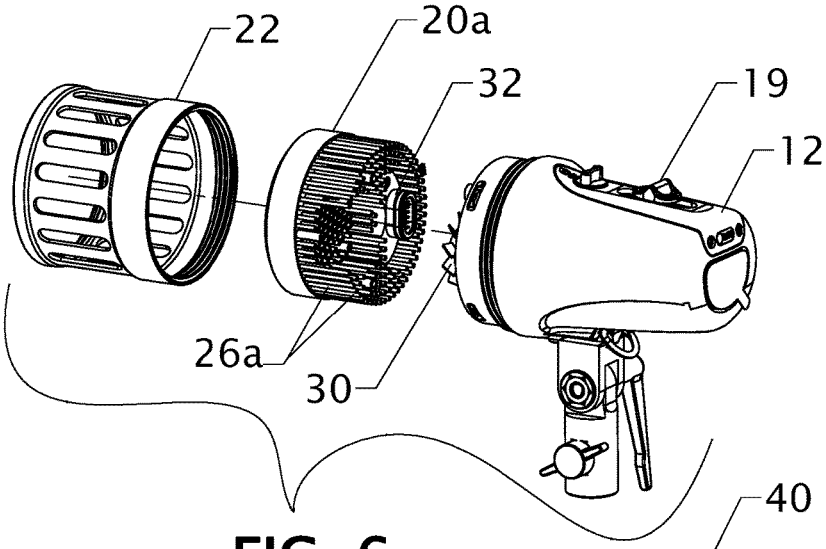
FIGS. 6 and 7 are exploded perspective views showing a modification.
Figure 7:
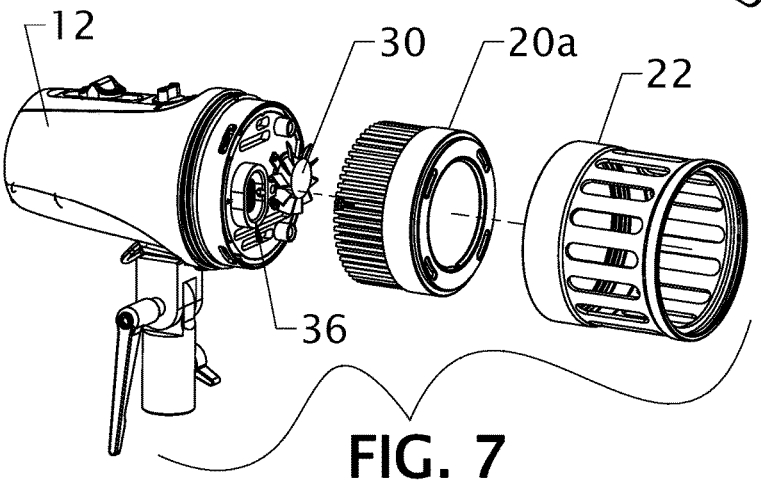

The perspective exploded views of FIGS. 6 and 7 show an assembly similar to that of FIGS. 4 and 5, but with the fan 30 secured on the body 12, rather than being incorporated into the LED/heat sink head 20*a*. The offset position of the pin connector hubs 32, 36 again allows space for the fan 30, and the heat sink pins 26*a*, as before, are absent in the space to be occupied by the fan 30 when the assembly is made.

In one embodiment, the fan motor is internal to the body, with only a sealed shaft extending through the body and supporting the fan 30 on its outer end. Thus, even if the front of the body 12 is exposed to water, the motor will not be affected as it is sealed inside the body. So the unit is still waterproof. If the body is placed in water, a sensor (not shown) indicates that the fan does not need to turn on. Therefore the body 12 is universal for above-ground and underwater use, including a fan that only works if the head calls for more cooling. In water it will not call for more cooling.

The inclusion of the fan 30 in the embodiments of FIGS. 1-9 allows the LED head to deliver about 10,000 lumens of output, or more. The variable-speed fan comes on preferably when 5000 lumens output is selected by the user, under control of electronics in the body 12. Electronics, such as temperature-sensing electronics, or a thermistor can be included in the head 20 for control of the fan. If the fan is in the body, the control is by communication of the head with the body. The fan will run at low speed up to about 7000 lumens, switching to high speed over about 7000 lumens. The fan variation allows the user to run the light in a quiet mode with the fan off or at low power when possible, which is preferred in some applications as opposed to having the fan constantly operating. One example is when the light is mounted on a camera used to do a live interview, where fan noise would interfere with the recorded sound.

Note that each head of the modular system can have an identification pin, as one of the pin connectors extending between the head and body. This tells the body what head is attached and thus has to deliver power to it. One of the pins that connect between the LED head and the body is an identification pin that is coded with different resistance thereby indicating the model head the body needs to drive. A head with a fan can accept higher current and deliver more lumens. The body will deliver this higher output and read to the screen (FIGS. 14, 15) at the rear of the product the lumen output of the head and the battery life remaining at that output. A head without the fan would not be allowed as much current as a head that is actively cooled. Additionally a 3200 Kelvin head would have a lower lumen output at a given power than a 5600 Kelvin head as the 5600K LED array is more efficient than the warmer color temperature heads. All this calibration is managed in the light's firmware on the body side of the light. The head just tells the body what head is connected and thereby what the output and power levels will be.

Figure 10:
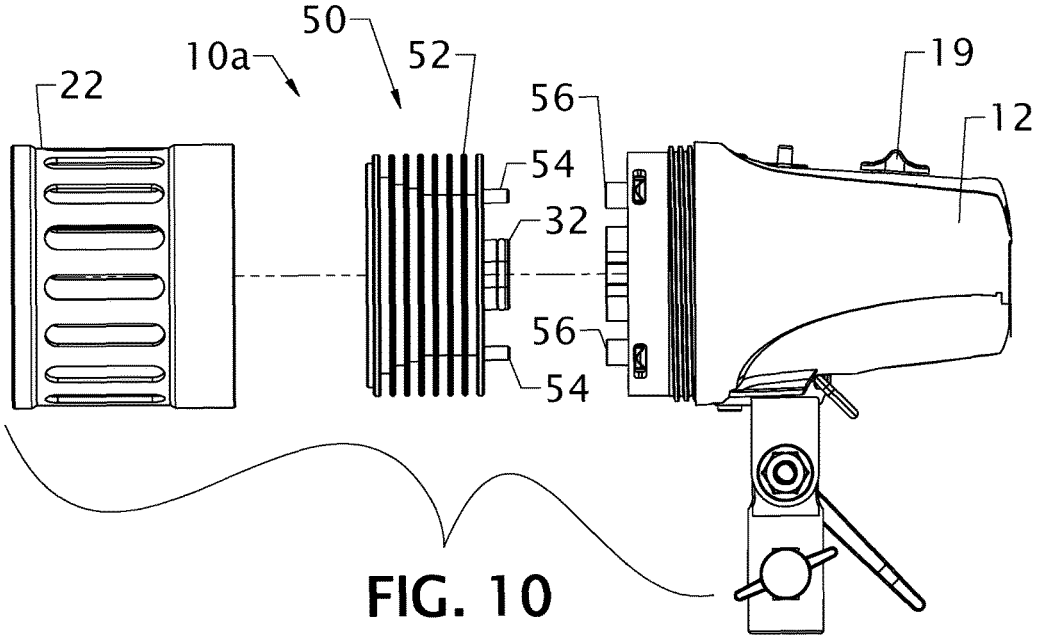
FIG. 10 is an exploded side view showing the body with a different interchangeable LED head.

FIG. 10 shows the same light body housing 12 but with a different LED/heat sink head 50, interchangeable with the above-described LED/heat sink head 20. In this case the heat sink can comprise a series of fins 52 that are essentially disks that extend radially outwardly. This head 50 is ambient air-cooled in a passive manner without the need for a fan. The lighting unit 10*a* with this head can deliver up to about 5000 lumens of output. Note that two alignment pins 54 are included at the back of the head 50, outboard from the center line, serving to align the head when making the connection between the heat sink 50 and the body or driver 12. The body has receivers 56 for the alignment pins 54, to ensure the non-symmetric connection is made properly. In a variation, the connectors could be symmetric in order to make alignment easier, but in the embodiment shown the connection hub 32 is off-center (as in FIG. 9) to allow better air flow through the cooling fins. The head shown with the radial fins is one way to cool the head. This design is entirely passive and therefore can't deliver the same lumen output of the actively cooled heads, but has the advantage of simplicity and lower cost and quiet performance. The LED array is placed as close to the face of the heat sink assembly as possible in order to achieve the widest beam angle and minimize light losses.

Figure 11:
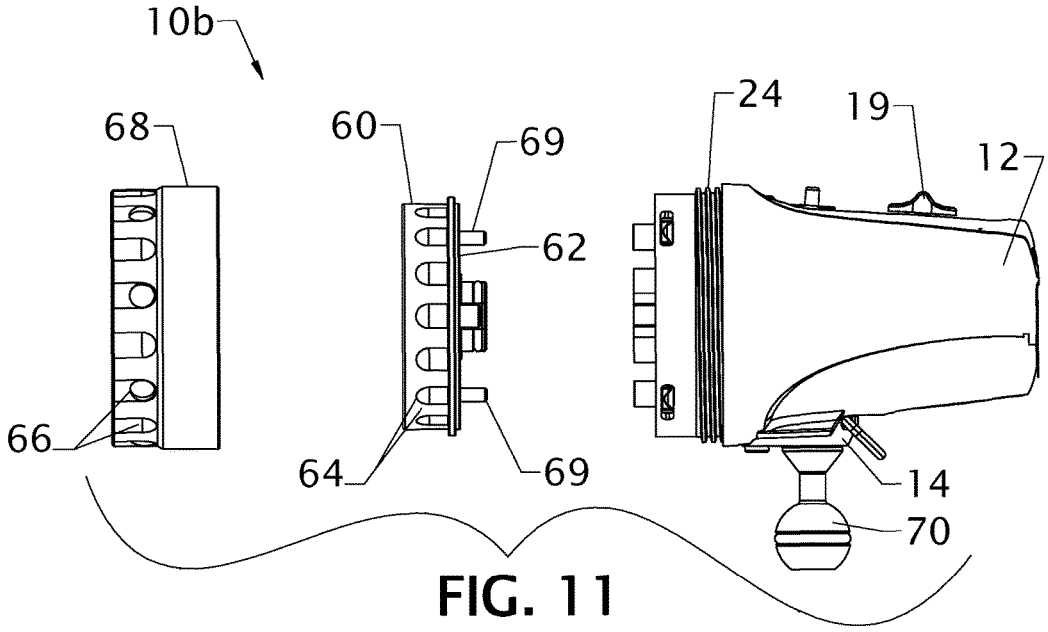
FIG. 11 is another exploded side view showing the body with a third interchangeable LED head and smaller bezel, this head optimized for underwater use and cooled by ambient water.

FIG. 11 is another exploded view showing the same body or driver 12 receiving a third type of LED head 60. This form of head 60 is without cooling fins or pins, but includes a smaller heat sink 62, essentially a metal base plate to which the LED array is secured (array not shown), the light assembly 10*b* being for underwater use. As in U.S. Pat. Nos. 9,188,292 and 8,864,326 referenced above, this head 60 allows the intrusion of ambient water through openings 64 in the LED head, admitted by openings 66 in a modified bezel 68 for the underwater lighting unit 10*b*. The holes 66 in the modified bezel 68 allow water to circulate freely around and against the aluminum LED plate 60. The LED plate mounts with a gap created by the alignment pins 69 between the body and the LED plate, which allows water (or air) to circulate on all sides of the LED plate, side, back and face.

The bezel is again screwed onto the body via threads 24 to retain the LED/heat sink head in a sealed connection, and the bezel also serves as an outer shell that will protect the user to some extent from the high heat generated at the heat sink surface, which can be as high as about 80° C.

The disclosure of U.S. Pat. Nos. 9,188,292 and 8,864,326 relating the admission and circulation of ambient water as cooling water for LEDs, is incorporated herein by reference.

In FIG. 11 a different type of mount, i.e. a ball mount 70, is shown connected to the mount base 14. This can be compatible with underwater camera housings. The ball mount is typical of highly mobile applications found in underwater filming. The mounting apparatus shown for the other assemblies are conventional mounts used to work on tripod stands and "C" stands.

Further versions of LED/heat sink heads can be provided, with different characteristics of light intensity, color and spot/wide angle values. Each of the heads is identified uniquely, so that when plugged into the driver/body 12, the electronics of the driver will discern the head type and will deliver the appropriate power. The driver 12 has multiple firmware options to drive the different heads.

The modular, interchangeable-head light apparatus of the invention has several important advantages. For one thing, users want to change color temperature. Typically users want 5600 Kelvin which matches sunlight, or 3200K which matches incandescent fixtures. It depends on the filming location. Conventional methods for this are (1) start with daylight LEDs and add a "gel" to change the color temperature—the advantage of this is simplicity, but losses can be as high as 30%, significantly reducing the light output; (2) LED array with multi color LEDs in the array ("bi-color")—the advantage of this approach is the users can dial in the color temperature desired, although the LED light is only half as powerful as a similar-sized array of all one color temperature, as at any point in the mixing of 5600K and 3200K at least half of the LEDs are not being used. Bi-color heads can also be unstable, as noted above. The system of the invention allows easy swapping of the head to obtain the full power of the LED array, optimized to deliver highly accurate and stable color temperature. However, this modular system can include as part of the series of heads a bi-color head if desired.

Further, an embodiment of the invention can include, as one or more of a collection of interchangeable heads, a bi-color LED head. Like the other heads, this head will be identified to the body in the usual fashion noted above and the body will have the ability to mix the different color temperature LEDs to create specific desired color temperatures from a single head. This head will not be as powerful as the dedicated single color temperature heads, but will allow a degree of flexibility the other heads can't offer, and is part of a collection of different choices. In this case a different type of switch can be provided, such as three separate buttons, still preferably waterproof, on the outside surface of the body or head (e.g. as in FIG. 2A). As an example, one switch button can be effective to increase light output, while another is effective to decrease light output. A third button can be used to change mode, i.e. light color temperature. Successive pressing of the button can successively move the light from tungsten toward daylight color temperature, for example. At either extreme, further pressing of that button can reverse the light color trend, or reversing could be made effective by pushing the third button and one of the other buttons.

As LEDs continue to improve, the modular design allows the user to upgrade just the head, which is the lowest cost of the overall system, and to continue to get full utility from the body/driver assembly. With other lights one would need to replace the entire light unit to get the next generation of higher power LEDs.

Figure 14:
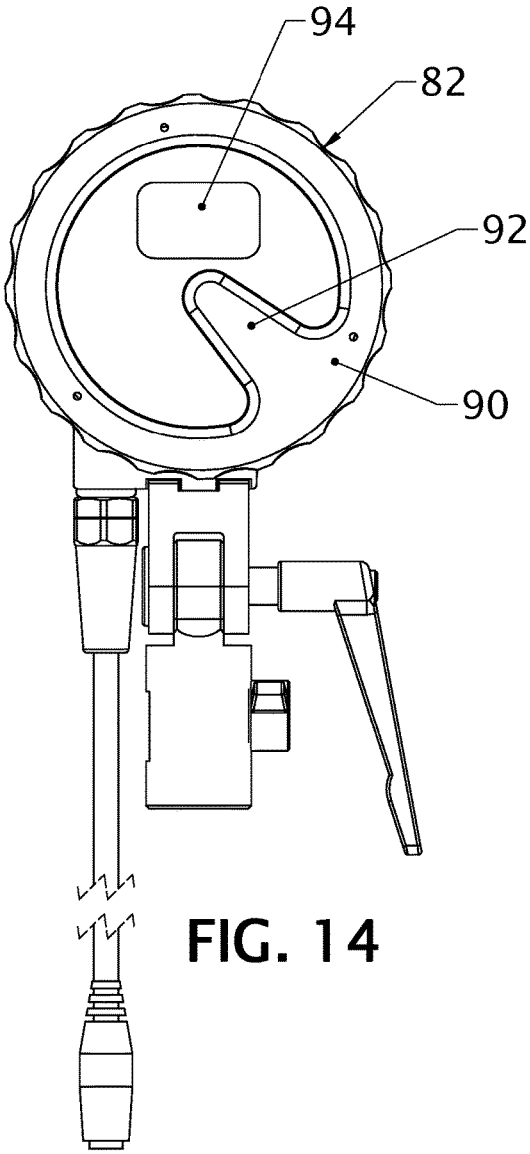

FIGS. 12-14 show another embodiment of the invention, wherein line power (or a remote battery) is used for the light 80, without inclusion of a battery case. FIG. 12 shows the light assembly 80 includes a small body 82, smaller than the light head 20, since the body carries no battery but only relatively compact electronics. A mounting device 18 is shown extending from the bottom of the body 82, and this can be similar to mounting connectors discussed previously. A cable 86 extends from the body, with a terminal 88 configured to connect to a power supply served by line power, or alternatively, to connect to a remote battery pack.

The cable can permanently extend from the body or could be connected via a port on the body. When the battery is in the body (as described above), it is the battery that limits the LED output, not the head. A remote power supply can deliver approximately 20% more output than the onboard battery version. The battery has an internal resistance that increases the overall heating load of the device and thereby limits the overall power that can be directed to the LED.

FIG. 13 shows an exploded view of the light assembly 80, revealing some of the structure of the body 82, which may be disc-shaped as shown, having a receiving hub 36 and other features such as shown in earlier-described embodiments of the body 12. The head 20 can be similar to those described above, and it should be understood that the body can support a motor-driven fan rather than the fan being located in the head, as explained above with reference to FIGS. 6 and 7. Of course no fan is utilized in the event the light is used underwater, but the fan can still be present if included in the head.

FIG. 14 shows the rear side of the lighting device of FIGS. 12-13, the light being powered from a remote source. A rotary dial 90 controls the lumen power of the light. The dial 90 preferably is plastic and a finger pointer 92 has a magnet enclosed. As the dial rotates the polarity of the magnet is sensed with a sensor inside the body and directly opposite the finger tip. In this manner the power setting for the light is manually controlled by the user. Above the finger tip of the control ring is a window 94 with an OLED screen, which gives the user information about the performance of the light: including remaining run time at the given power level, lumens, as well as percent battery charge when the unit is plugged into a power supply, telling the user when the battery power supply is fully charged.

The term "power means" for powering the light assembly, as used herein and in the claims, is intended to encompass both a battery contained in the body and the alternative of a cable or connection port for connection to a separate or remote power supply (which could be a battery or line power).

Figure 15:
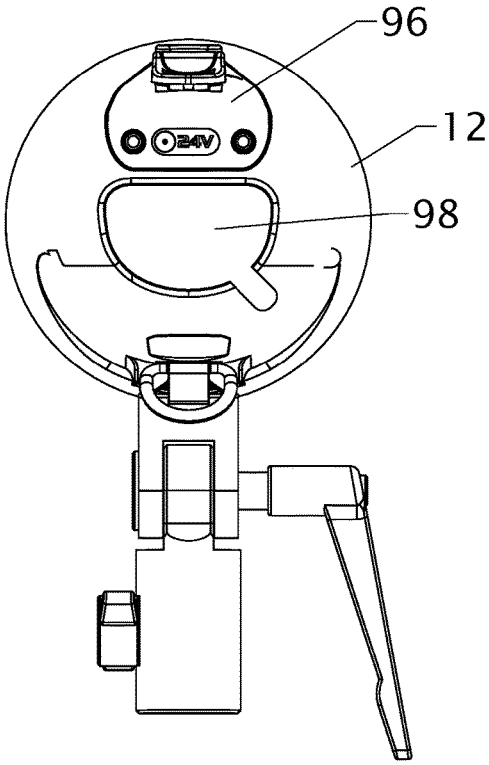
FIG. 15 shows the back end of the lighting device of FIG. 1.

FIG. 15 shows the rear side of the lighting device body 12 of FIG. 1, the body having an internal battery. The rear view shows a receiver 96 for charging the battery, about a screen 98 that provides information for the user similar to that described above for the screen 94 in FIG. 14.

Figure 16:
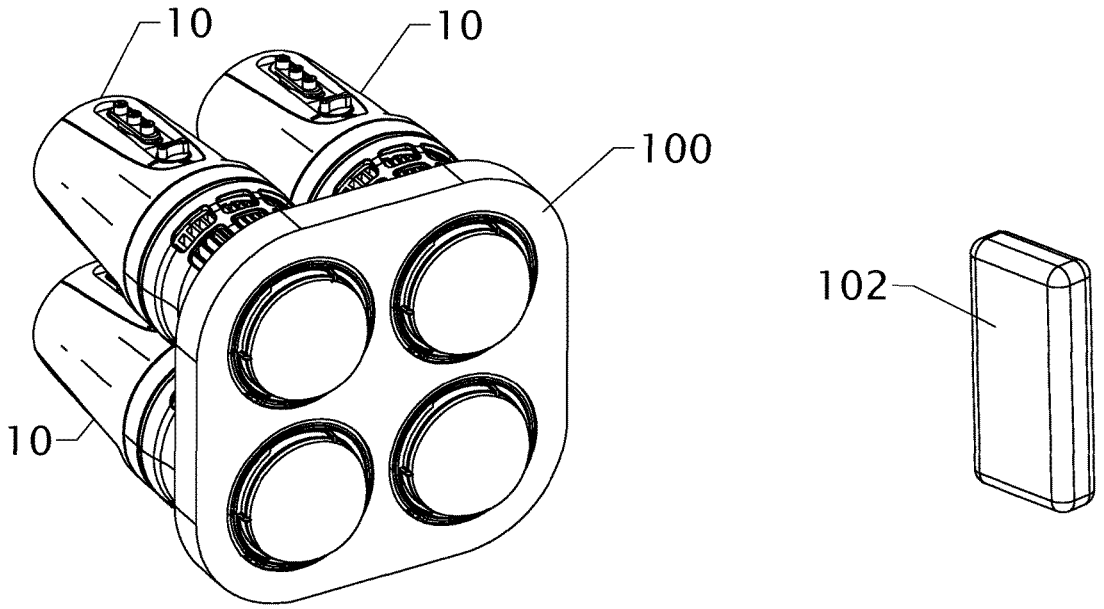
FIG. 16 shows an assembly of four LED light units in an embodiment of the invention when light color is adjustable by using different combinations.

In another implementation of the invention shown in FIG. 16, color mixing is achieved by utilizing a series of light assemblies that can selectively be mounted on a frame 100 that holds, for example, four of the light assemblies 10. Each light assembly has LEDs that produce one color of light, which can be, for example, tungsten or daylight. In one preferred set of components two of the units 10 are 5600K and two are 3200K. For a desired color to be projected, one can select, for placement on the frame, all units of the first color, all units of the second color, or three and one (or vice versa), or two and two. Intensity can be modulated in one or more of the units to modulate light color and brightness. In addition, a light meter can be used for automatic control of the light units on the frame, with the light meter sensing and feeding back intensity as well as the mixed light color. For example, this can be a Sekonic light meter with RF control. FIG. 16 shows such a light meter device 102, for remote wireless control (e.g. RF or Bluetooth) to provide for direct color management to allow the light source to match the background light color temperature. The Sekonic light meter (model 1-478DR-U-EL) is one such device that would allow direct mixing of the four sources to match ambient as measured on the meter and controlled by the meter. Other controls can be similar but the metering and adjustment can be in separate devices, one to measure ambient color temp and a separate device to adjust the light array.

The invention encompasses a modular set of parts or components: a body that provides power and a means for mounting the lighting device (such as on a stand), and which may include some of the electronics for power control and for driving the LEDs; and a series of different, separate modular LED heads, each being easily attachable to the body and interchangeable and each providing different light characteristics, for use in different situations and applications.

The above described preferred embodiments are intended to illustrate the principles of the invention, but not to limit its scope. Other embodiments and variations to these preferred embodiments will be apparent to those skilled in the art and may be made without departing from the spirit and scope of the invention as defined in the following claims.

We claim:

1. A modular, high-intensity LED light assembly with a series of light options, comprising:

a body with electronics contained within the body, the body being sealed against moisture and including power means for powering the light assembly, a series of separate, different LED heads, each with a heat sink to dissipate heat from LEDs in the LED head, and each being connectable individually and interchangeably against said body such that the LEDs of the LED head are driven by the power means and electronics in the body, the LED heads including at least:

(a) a first air cooled LED head with spaced heat sink elements positioned to withdraw heat from the LEDs to be dispersed into ambient air surrounding the LED head, for a highest LED output in air, (b) a second air cooled LED head with spaced heat sink elements positioned to withdraw heat from the LEDs by purely passive air cooling such that the head is dispersed into ambient air surrounding the LED head for a lower LED output in air, lower than the LED output of the first air cooled LED head, and the electronics in the body including means for recognizing which LED head has been secured to the body, and for supplying a level of power appropriate for driving the LEDs of the attached LED head.

2. The LED light assembly of claim 1, further including a motor-driven fan positioned on either of the first air cooled LED head or the body in position to operate in a space among the heat sink elements for operation when the first air cooled LED head is connected to the body.

3. The LED light assembly of claim 2, wherein the motor-driven fan is positioned on the body, including a motor sealed within the body against intrusion of water.

4. The LED light assembly of claim 2, wherein the motor-driven fan is positioned on the first air cooled LED head.

5. The LED light assembly of claim 1, wherein the means for recognizing which LED head has been secured to the body comprises a pin connector between the body and any of the LED heads, the pin connector including an electrical pin which conveys data from the head to the body as to which LED head has been secured to the body.

6. The LED light assembly of claim 1, wherein at least some of the different LED heads have different angles of light projection.

7. The LED light assembly of claim 1, wherein at least some of the different LED heads project light of different temperatures.

8. The LED light assembly of claim 1, wherein the first air cooled LED head has a light intensity output of at least about 10,000 lumens.

9. The LED light assembly of claim 1, wherein the second air cooled LED head has a light intensity output of at least about 5000 lumens to about 7000 lumens.

10. The LED light assembly of claim 1, wherein the body with any of the LED heads defines an outside diameter no greater than about three inches.

11. The LED light assembly of claim 1, wherein the LED heads further include (c) an underwater LED head with a small, single-element heat sink, the underwater LED head being open to allow ambient water to enter a space between the underwater LED head and the body so that the LEDs are cooled by ambient water contacting the small heat sink when the light assembly is used underwater.

12. The LED light array of claim 1, wherein the power means comprises a battery contained within the body.

13. The LED light array of claim 1, wherein the power means comprises a cable for connecting to a remote power supply.

14. The LED light array of claim 1, wherein the series of LED heads includes a series of color mixing heads each with an attached body forming a light unit, and a frame to support the series of light units, the different units of the series including units producing different light color temperatures so that different combinations of the series of units can be powered to produce desired mixed colors of light.

15. The LED light assembly of claim 1, wherein the LED heads further include a bi-color head with two groups of LEDs, one group producing a low color temperature and the other a high color temperature, with color switching means for adjusting proportions of the two groups of LEDs that are powered.

16. The LED light assembly of claim 1, wherein at least some of the different LED heads project light of different color temperatures.

17. The LED light assembly of claim 1, wherein the first air cooled LED head has a light intensity output of at least about 10,000 lumens.

18. The LED light assembly of claim 1, wherein the second air cooled LED head has a light intensity output of at least about 5000 lumens to about 7000 lumens.

19. The LED light assembly of claim 1, wherein the body with an assembled LED head has an outside diameter no greater than about three inches.

20. A modular, high-intensity LED light assembly with a series of light options, comprising:

a body with a battery and electronics contained within the body, the body being sealed against moisture, a series of separate, different LED heads, each with a heat sink to dissipate heat from LEDs in the LED head, and each being connectable individually and interchangeably against said body such that the LEDs of the LED head are driven by the battery and electronics in the body, the LED heads including:

(a) a first air cooled LED head with spaced heat sink elements positioned to withdraw heat from the LEDs, and with a motor-driven fan positioned to move ambient air through and among the heat sink elements, for a highest LED output in air, (b) a second air cooled LED head with spaced heat sink elements positioned to withdraw heat from the LEDs, and being without a fan, for a lower LED output in air, (c) an underwater LED head with a small, water-contacting heat sink, the underwater LED head being open to allow ambient water to enter a space between the underwater LED head and the body so that the LEDs are cooled by ambient water when the light assembly is used underwater, and the electronics in the body including means for recognizing which LED head has been secured to the body, and for supplying a level of power appropriate for driving the LEDs of the attached LED head.

21. The LED light assembly of claim 20, wherein at least some of the different LED heads project light of different color temperatures.

22. The LED light assembly of claim 20, wherein the first air cooled LED head has a light intensity output of at least about 10,000 lumens.

23. The LED light assembly of claim 20, wherein the second air cooled LED head has a light intensity output of at least about 5000 lumens to about 7000 lumens.

24. The LED light assembly of claim 20, wherein the underwater LED head has a light intensity output of at least about 10,000 lumens.

25. The LED light assembly of claim 24, wherein the body with an assembled LED head has an outside diameter no greater than about 3.5 inches.

26. The LED light assembly of claim 20, wherein the body with an assembled LED head has an outside diameter no greater than about 3.5 inches.

27. The LED light assembly of claim 20, wherein the spaced heat sink elements of the first air cooled LED head comprise a multiplicity of parallel pins extending axially relative to the length of the body.

28. The LED light assembly of claim 27, wherein the heat sink pins are essentially evenly spaced but interrupted to form a space within which the motor-driven fan is positioned.

29. A modular, high-intensity LED light assembly with a series of light options, comprising:

a body with a cable or connection terminal for connecting to a remote power supply, the body being sealed against moisture, a series of separate, different LED heads, each with a heat sink to dissipate heat from LEDs in the LED head, and each being connectable individually and interchangeably against said body such that the LEDs of the LED head are driven by the power supply and electronics in the body, the LED heads including:

(a) a first air cooled LED head with spaced heat sink elements positioned to withdraw heat from the LEDs to be dispersed into ambient air surrounding the LED head, for a highest LED output in air, (b) a second air cooled LED head with spaced heat sink elements positioned to withdraw heat from the LEDs by purely passive air cooling, for a lower LED output in air, a motor-driven fan positioned on either of the first air cooled LED head or the body in position to operate in a space among the heat sink elements for operation when the first air cooled LED is connected to the body, and the LED light assembly including electronics with means for identifying which LED head has been secured to the body, and for supplying a level of power appropriate for driving the LEDs of the attached LED head.

30. The LED light assembly of claim 29, wherein the LED heads further include (c) an underwater LED head with a small, water-contacting heat sink, the underwater LED head being open to allow ambient water to enter a space between the underwater LED head and the body so that the LEDs are cooled by ambient water when the light assembly is used underwater.

* * * * *